United States Patent [19]

Theilacker

[11] Patent Number: 4,748,909

[45] Date of Patent: Jun. 7, 1988

[54] TRANSVERSE STRETCHING APPARATUS FOR A MOVING WEB

[75] Inventor: Klaus Theilacker, Friedberg, Fed. Rep. of Germany

[73] Assignee: M.A.N. Roland Druckmaschinen Aktiengesellschaft, Offenbach am Main, Fed. Rep. of Germany

[21] Appl. No.: 930,337

[22] Filed: Nov. 12, 1986

[30] Foreign Application Priority Data

Dec. 20, 1985 [DE] Fed. Rep. of Germany ..... 3545270

[51] Int. Cl.[4] ..... B41F 13/56

[52] U.S. Cl. ..... 101/226; 26/99; 162/271; 226/192

[58] Field of Search ..... 101/226; 26/99–102; 226/179, 184, 185, 189, 192; 162/202, 204, 223–224, 271, 287, 289, 314

[56] References Cited

U.S. PATENT DOCUMENTS

| | | | |
|---|---|---|---|
| 813,288 | 2/1906 | Hancock | 26/99 |
| 920,122 | 5/1909 | Farnworth | 26/102 |
| 4,223,426 | 9/1980 | Demiere | 162/271 |
| 4,693,587 | 9/1987 | Shigenobu et al. | 162/271 |

FOREIGN PATENT DOCUMENTS

| | | | |
|---|---|---|---|
| 2139159 | 1/1974 | Fed. Rep. of Germany . | |
| 785680 | 10/1957 | United Kingdom | 226/192 |
| 939351 | 10/1963 | United Kingdom | 226/184 |

*Primary Examiner*—E. H. Eickholt

*Attorney, Agent, or Firm*—Frishauf, Holtz, Goodman & Woodward

[57] ABSTRACT

To simplify a transverse stretching apparatus and provide rollers which do not require a change in the respective axes of rotation, two rollers are located adjacent, parallel, and spaced from each other, in which each of the rollers have outer cylindrical sections of respectively different diameters, with an intermediate essentially conical section, merging smoothly with the outer cylindrical section. The rollers are so located that the smaller diameter circumferential section of one of the rollers (4) is opposite the larger circumferential section of the other roller (5), and, when in essentially axial alignment, define a neutral position in which the sums of the diameters of the rollers at any axial plane passing transversely through the axes of rotation, will be the same. Upon relatively axially shifting the rollers with respect to each other (compare FIGS. 1 and 3), the sums of the diameters of the rollers at the still transversely aligned cylindrical portions will remain the same, but the sum of the diameters at the shifted intermediate portions will either increase or decrease, in dependence on the direction of shift, thereby providing increased or decreased stretching force to the intermediate range of the web looped about said rollers.

6 Claims, 1 Drawing Sheet

TRANSVERSE STRETCHING APPARATUS FOR A MOVING WEB

The present invention relates to web handling apparatus, and more particularly to apparatus to provide for transverse stretching of a moving web, for example and especially a paper web received from a printing machine, a web of fabric, or the like.

BACKGROUND

Moving webs, particularly webs which are comparatively wide, have a tendency to uneven lateral stretch; sometimes the edge regions may curl slightly or, at the other times, the center regions may be slightly wavy or undulating. It has previously been proposed to provide for transverse stretching of such a moving web by positioning a transverse stretching roller in the path of the web. The transverse stretching roller is bent or bowed transversely to the moving direction of the web. Such a roller is a composite element formed of a plurality of roller elements, so that the degree of bending or bowing of the overall roller can be individually adjusted by adjusting the individual roller elements with respect to each other - see, for example, German Pat. No. 21 39 159. A roller construction of this type is a complex apparatus, and substantial mechanical equipment and linkages are necessary to permit the adjustment of the bending or bowing of the roller for effective stretching of the web, selectively at a central portion or at the edge portions.

THE INVENTION

It is an object to provide a transverse stretching apparatus which does not require adjustment of a bending or bowing radius or location of a bent roller, that is, which utilizes fixed roller jackets or circumferences, which do not change, but which apparatus, nevertheless, should be capable of adjustement to permit different transverse stretching effects.

Briefly, a pair of rollers are provided, located transversely to the running web. The rollers are spaced from each other by some small distance, for example approximately in the order of a mean diameter of the rollers, or somewhat less, or somewhat more; the rollers do not, however, normally touch each other. The web is looped about the roller in an S looping form. Each one of the rollers has three axially staggered circumferential roller sections. The two outer ones of the circumferential roller sections are cylindrical, and have, however, different diameters; the intermediate roller section is essentially conical, preferably merging smoothly with the cylindrical roller sections at the end portions. The cylindrical roller sections may be about ¼ or 1/5, each, of the respective axial lengths of the rollers, and the conical section, with the transition zone to the cylindrical section, about ½ or 3/5 of the axial length. The rollers are so positioned that the larger one of the circumferential or diametrical section of a first roller is adjacent the smaller one of the other roller, and such that, with the rollers in essentially axial alignment, the sums of the circumference of the first and second rollers, at any plane passing perpendicularly through the axes of the parallel rollers is the same. A web passing over these rollers will not be stretched at any transverse position since, as has been noted, the sum of the diameters of the two rollers is the same at any transverse position. In order to provide for stretching of the web, selectively, at the edge portions or at the center portions, the two rollers are shifted, axially and parallel, with respect to each other, such that, at the selected positions, the sums of the diameters of the rollers about which the web will then be looped will no longer be the same, but, rather, will differ along the axial extent of the rollers or, in other words, transversely of the webs. If the rollers are shifted such that the sums of the diameters at the edge portions are greater than at the central portion, then of course the web will be stretched at the end portions; the shift may, however, also be reversed, so that the sums of the diameters at the central portion will be greater than sums of the diameters at the edge portions and, then, the stretching effect will be obtained at the center.

The system has the advantage that the circumferences or jackets of the roller need not be changed in any way, the only requirement for adjustment of the stretching effect, transversely to the moving web, being an axial lateral movement of the rollers which can be easily accomplished by well known structures. The system, thus, has the substantial advantage of simplicity and, since all rollers rotate only about a fixed axis of rotation, the overall wear on the rollers will be a minimum.

DRAWINGS

FIG. 1 is a schematic side view of a roller pair in accordance with the present invention, located in axially aligned position, defined as a neutral position;

FIGS. *2a, 2b* and *2c* are end views taken along lines 1, 2, 3 of FIG. 1, with hatching omitted for ease of illustration, the horizontal alignment of FIG. 1 and FIG. 2—collectively being the same;

FIG. 3 is a side view similar to FIG. 1 showing the axial shift of two rollers; and FIGS. *4a, 4b, 4c* correspond to FIGS. *2a, 2b, 2c* and illustrate the path of a web about the rollers at the positions 1, 2, 3 of FIG. 3.

DETAILED DESCRIPTION.

Figures 1, 2A, 2B, 2C, 3, 4A, 4B, 4C:
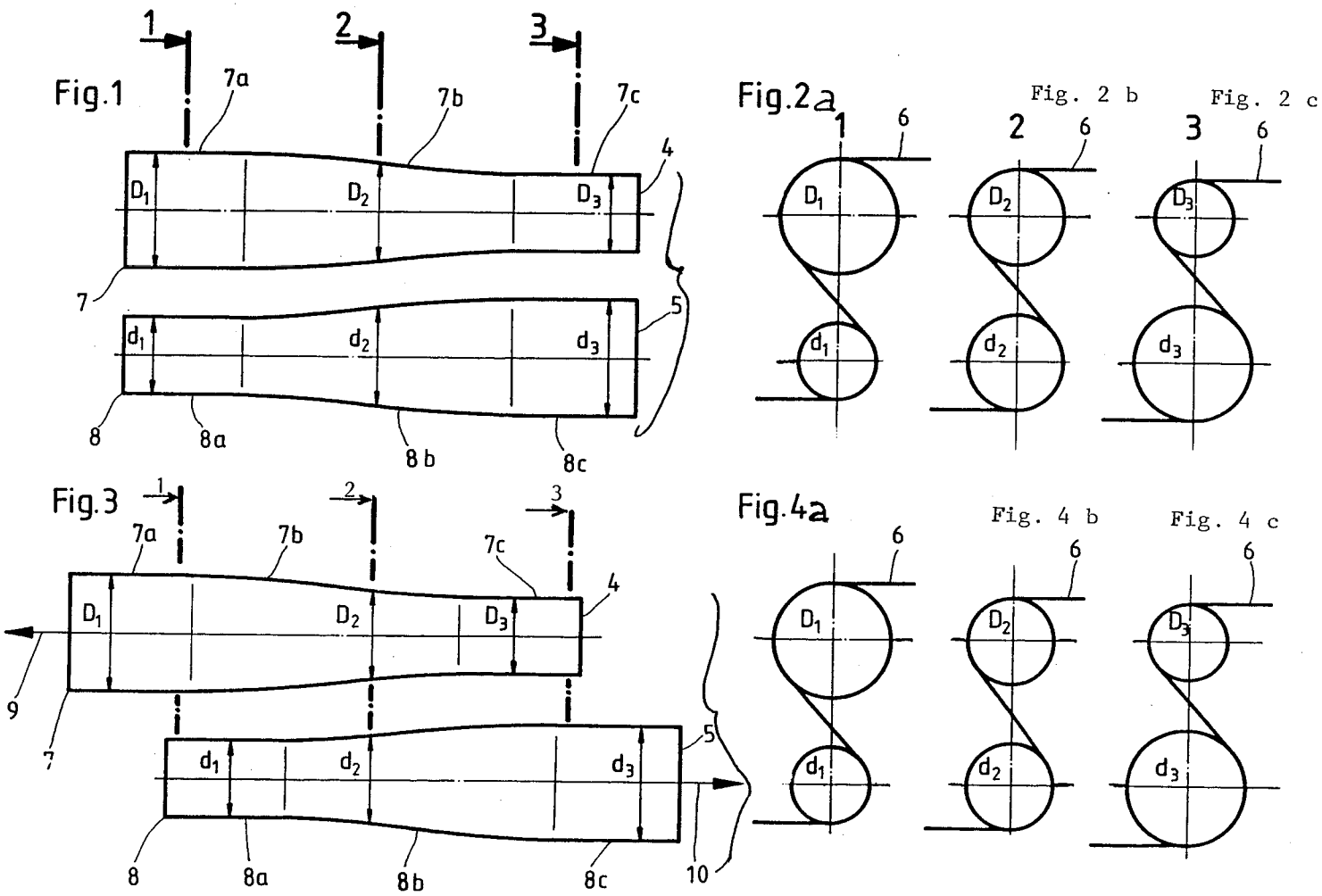

A substrate web 6, for example a printed paper web received from a printing machine, is carried in S shape or form about rollers 4, 5—see FIGS. 1 and 2. The rollers 4, 5 are located with their axes of rotation parallel to each other. One of the rollers, but preferably both rollers 4, 5 can be axially shifted with respect to each other. The rollers can be retained in bearings in suitable side walls—not shown—permitting axial shifting while being rotated, for example by gears which are shiftably splined to the roller shafts. The axial shift of the rollers can be controlled, for example by a cam, manually, or by a motor, continuously and without specific steps, and should be possible to be carried out during rotation of the rollers, that is, during the running of the web 6 about the rollers. Any well known and suitable structure may be used for shifting the rollers axially with respect to each other.

As best seen in FIGS. 1 and 3, the rollers 4, 5 have two cylindrical cross-sectional areas which taper towards each other. Roller 4 has a jacket 7 with three jacket or circumferential portions *7a, 7b, 7c*, in which the circumferential portions *7a* and *7c* are cylindrical, the circumferential portion *7c* being of lesser diameter than that of *7a*. Likewise, the jacket 8 of the roller 5 has three portions *8a, 8b, 8c*.

The center portion is formed as a conical section which may be partly bulging, partly depressed, for example in accordance with a very flat sine wave, to merge smoothly with the cylindrical portion *7a, 7c; 8a, 8c.*

In accordance with a feature of the invention, the rollers are so placed that one end of a first roller, for example the end portion *7a* of roller 4, which has the largest diameter D1, is opposite the cylindrical portion *8a* having the smallest diameter d1 of the second roller 5. Similarly, the largest cylindrical portion 8c having the largest diameter d3 of the roller 5 is opposite the smallest cylindrical portion *7c* of roller 4, having the smallest diameter D3. The slope between the respective jacket of circumferential surface. portions is provided by the conical or curved sections *7b, 8b,* in which the cone or curve angles extend in opposite directions.

The rollers 4, 5 are shown in FIG. 1 in neutral position in which the rollers are so arranged that the looping path of the web 6, taken across the axial extent of the rollers, has the same length at any axial position. Disregarding neglectable differences due to the changing position of the tangents, which are minor, the sum of the diameters D1+d1; D2+d2 and D3+d3 of the rollers 4 and 5 at any axial position will be the same, as can be seen, for example, at the section zones 1, 2, 3, compare FIG. 1 at the section lines with FIGS. *2a, 2b, 2c.* The FIGS. *2a, 2b, 2c* to the section lines 1, 2, 3 of FIG. 1. FIGS. *2a–2c* clearly show the respective relationship.

In accordance with a feature of the invention, the rollers 4, 5 can be shifted axially with respect to each other, which is generally indicated by arrows 9, 10 in FIG. 3. The drawings, FIG. 1 and FIG. 3, as well as FIG. 2 and FIG. 4, collectively, are drawn in vertical and horizontal alignment, respectively, for ease of analysis. When the rollers 4, 5 are shifted axially with respect to each other—see FIG. 3 the sum of the looping distance of the S-formed loop at the cylindrical jacket portions *7a, 8a* and *7c, 8c* remains the same. At the intermediate roller portions *7b* and *8b,* however, the sum of the looping distance has become smaller, so that the distance any incremental portion of the web must pass for looping about the rollers likewise has become less. Consequently, the web will be deflected in the center portion for a smaller distance than at the end portions and thus will be subjected to lesser tension than at the end portions. By providing a drive downstream of the roller pair, applied to the web 6, it is now readily possible to maintain the tension in the center of the web constant, whereas at the edge portions of the web, an increase in tension will be obtained.

Moving the rollers 4, 5 with respect to each other opposite the direction of the arrows 9, 10 is shown, the opposite effect will be obtained—an increase in tension in the center portion of the web 6 with respect to the edge portions.

The tangent of the cone angle of the center portions *7b, 8b* should always be sufficiently lower than the coefficients of friction between the rollers 4, 5 and the web 6 in order to prevent lateral drift of the web 6 during operation.

The smoothing effect of the rollers 4, 5 on the web 6 can be optimized by preventing a sharp transition between the cylindrical end portions *7a, 8a, 7c, 8c* and the essentially conical portions *7b, 8b.* Use of a mathematically determined curve, for example a sine function, can readily provide for a smooth, non-abrupt transition. The result will be a shape of the rollers 4, 5 which can be considered bottle-shape.

Adjustment of the respective axial shift should, preferably, be done during operation of the machine, that is, for example during operation of a printing machine. The respective shifting adjustment can easily be determined by observing the paper web, and noting if any flutter of the paper web occurs. Thus, the rollers can be shifted to eliminate such flutter by providing an optimum tension relationship. Different types or qualities of paper may require a different shifting. Once a shift for a certain quality of paper has been noted, it is readily reproducible, for example by reading off a standard gauge.

The system of the present invention thus permits compensation for and, hence, elimination of influences on the operation of a moving web. Such influences may, for example, be variations in thickness of a paper web, strength of the paper web, changes in modulus of elasticity due to differences in materials, moisture content or the like. The effects of such changes, thus, can be eliminated or, at least, so ameliorated that they are harmless. Specifically, differential stretching between the center of the web and the end or edge zones can be eliminated by rollers 4, 5. The looping of the web about the rollers 4, 5 with controlled zoned stretching also prevents flutter of the web, or any tendency of the web to form folds.

The pair of rollers 4, 5 can be used, as desired, at various positions in rotary printing machines, for example between the feed supply and a first printing station or printing system, between printing stations and printing systems, ahead of a folding apparatus, in folding and distribution apparatus, and the like.

I claim:

1. Moving web transverse stretching apparatus to provide for transverse stretching of a moving web (6), particularly for a moving web in combination with a printing machine, comprising a first (4) and a second (5) roller, forming a pair of rollers (4, 5), the first and the second rollers being located transversely to the running direction of the web, positioned parallel to each other, and spaced from each other;

the web (6) being looped in S looping form or shape about said rollers;

each of the rollers (4, 5) having three circumferential, axially staggered roller sections (*7a, 7b, 7c; 8a, 8b, 8c*), in which the axially outer ones of the circumferential roller sections are circular-cylindrical and of respectively different diameters, and the axially intermediate one of the circumferential roller sections (*7b, 8b*) is generally approximately conical, connecting the different-diameter outer sections (*7a, 7c; 8a, 8c*);

the first roller being positioned adjacent the second roller such that the larger diameter (D1) circumferential section (*7a*) of the first roller (4) is adjacent the smaller diameter (d1) circumferential section (*8a*) of the second roller (5), said rollers, when said larger and smaller respective cylindrical sections of said first and second rollers are in at least approximate axial alignment, defining a neutral position, in which neutral position the sums of the diameters of the first (4) and second (5) rollers at any plane passing perpendicularly through the axes of the rollers is the same;

and wherein at least one of the rollers (e.g. 5) can be shifted axially with respect to the other roller (5) and parallel thereto.

2. Apparatus according to claim 1, wherein both rollers (4, 5) are relatively shiftable axially with respect to each other.

3. Apparatus according to claim 1, wherein the intermediate, essentially conical sections merges smoothly with the axially outer cylindrical section.

4. Apparatus according to claim 1, wherein the essentially conical intermediate section (7*b*, 8*b*) follows a shallow mathematical curve comprising a sine wave, to form a smooth transition between the axially outer larger and smaller cylindrical sections (7*a*, 7*c*; 8*a*, 8*c*).

5. Apparatus according to claim 1, wherein the essentially conical intermediate section is in the order of about half the axial length of the respective roller, and each one of the axially outer cylindrical sections is about one-quarter of the axial length of the cylindrical sections.

6. Apparatus according to claim 1, wherein the axially outer cylindrical sections (7*a*, 7*c*; 8*a*, 8*c*) are about one-fifth of the axial length of the rollers, and the generally conical intermediate section (7*b*, 8*b*) including smoothly merging transition zones with the axially outer sections forms about three-fifth of the axial length of the respective roller.

* * * * *